United States Patent [19]

Nishida

[11] 4,060,780

[45] Nov. 29, 1977

[54] SIGNAL ATTENUATOR

[75] Inventor: Kouji Nishida, Hirakata, Japan

[73] Assignee: Matsushita Electric Industrial Co., Ltd., Kadoma, Japan

[21] Appl. No.: 747,385

[22] Filed: Dec. 3, 1976

Related U.S. Application Data

[63] Continuation of Ser. No. 588,159, June 17, 1975, abandoned.

[30] Foreign Application Priority Data

June 19, 1974 Japan ..... 49-70587

[51] Int. Cl.[2] ..... H01P 1/22

[52] U.S. Cl. ..... 333/81 A; 361/111

[58] Field of Search ..... 333/81 R, 81 A; 317/44; 323/74, 81, 94; 338/216, 306–309, 312; 361/111

[56] References Cited

U.S. PATENT DOCUMENTS

| | | | |
|---|---|---|---|
| 3,260,971 | 7/1966 | Bacher et al. | 333/81 A |
| 3,626,352 | 12/1971 | McCoig | 333/81 R X |

*Primary Examiner*—Paul L. Gensler

*Attorney, Agent, or Firm*—Cushman, Darby & Cushman

[57] ABSTRACT

This invention concerns a signal attenuator which can be used between an antenna and a television receiver or VHF/UHF radio, so as to appropriately attenuate VHF or UHF signals applied thereto. The signal attenuator comprises, in a shielding metal enclosure, an insulator substrate having an input electrode, an output electrode and a pair of ground electrodes, the electrodes being arranged symmetrical to each other with respect to a point on the substrate. The electrodes are arranged to define narrow gaps between the ground electrodes and the input and output electrodes. A set of flat shaped resistors is directly connected between the electrodes in symmetrical relationship with respect to the point on the substrate.

5 Claims, 7 Drawing Figures

SIGNAL ATTENUATOR

This is a continuation of application Ser. No. 588,159 filed June 17, 1975, now abandoned.

BACKGROUND OF THE INVENTION

This invention relates to a signal attenuator for use with a television set or an FM radio set.

Signal attenuators are widely employed being connected between a VHF or UHF antenna and a television receiver or an FM radio set in order to control the intensity of the incoming signal and to suppress external obstructive signals which interfere with the genuine signal from the antenna.

Hitherto, signal attenuators have constituted a $\pi$-type, T-type or O-type attenuator circuit with a resistance material layer vapor-deposited on a ceramic substrate, or with chip resistors connected to electrodes of a ceramic substrate or an insulation substrate of a printed circuit. Such attenuators are liable to destruction or damage when hit by lightning directly or by a high voltage impulse wave caused by the lightning, through burning or the bursting of the chip resistors or connection parts between the element and the electrodes, thereby interrupting signal transmission, or at best, losing the designed attenuation characteristics such as frequency linearity of the attenuation and impedance.

Some trials have been made to add a discharge gap element comprising a pair of wires or plates supported to define a specified discharge gap therebetween. However, such addition of the discharge gap element usually adds undesirable inductance or stray capacitance to the delicate VHF or UHF attenuator, thereby lowering high frequency characteristic or causing impedance mis-matching to the relevant circuit.

SUMMARY OF THE INVENTION

This invention concerns a signal attenuator which is used by being connected between a VHF or UHF antenna and a television receiver or a radio. The invention provides a novel signal attenuator which is not destroyed by lightning or by a high voltage impulse wave caused by lightning.

BRIEF EXPLANATION OF THE DRAWING

FIG. 5(*b*) is a circuit illustrating the test of the example, and

FIG. 5(*c*) is a graph showing the attenuation and voltage standing wave ratio characteristics of the signal attenuator of the present invention.

DETAILED DESCRIPTION OF THE INVENTION

Figure 1:
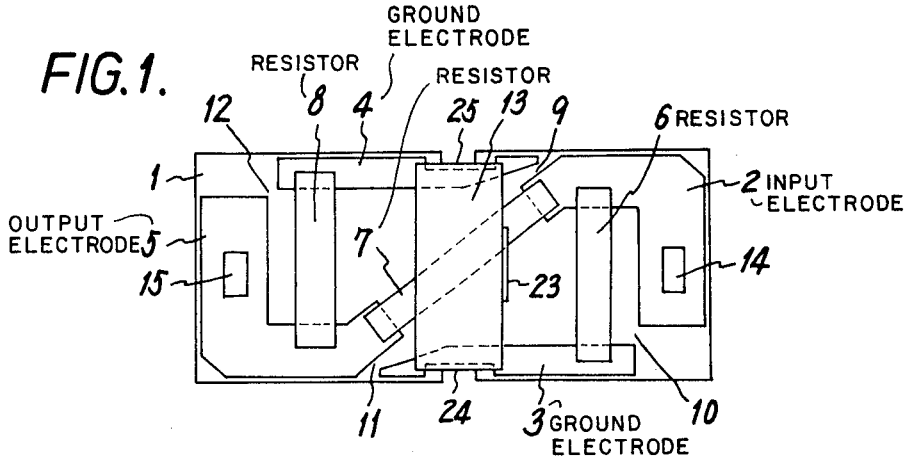
FIG. 1 is a plan view of a principal part of the signal attenuator of the present invention.
Figure 2:
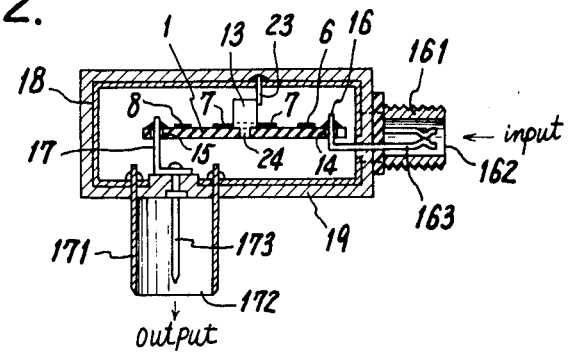
FIG. 2 is a fragmented sectional side view of the signal attenuator of the present invention.

Referring to FIG. 1 and FIG. 2 which illustrate the mechanical structure of the signal attenuator embodying the present invention, on one face of an insulator substrate 1 comprising a ceramic plate or a epoxy-resin plate reinforced by glass-fibres, etc., an input electrode 2 and an output electrode 5 are disposed symmetrically with respect to the center of the insulator substrate 1. A ground electrode 3 is disposed between a corner of the input electrode 2 and a corner of the output electrode 5 in a manner such that a pair of air gaps 10 and 11 are formed between the ground electrode 3 and the input electrode 2 and the output electrode 5, respectively. Another ground electrode 4 is disposed between another corner of the input electrode 2 and the another corner of the output electrode 5, so as to form another pair of specified air gaps 9 and 12 between the ground electrode 4 and the input electrode 2 and the output electrode 5, respectively. The gaps 9 and 12 are respectively symmetrical to gaps 11 and 10 with respect to the center of the insulation substrate 1. The gaps preferably are between 0.1 and 2mm in width, the optimum gap being about 0.3mm.

The electrodes 2, 3, 4 and 5 are formed by applying conductive paint comprising, for instance, a binder such as low melting point glass having conductive powder of such metals as silver, palladium-silver alloy or luthenium oxide to the insulator substrate 1. Heat is applied for fixing the paint on the insulation substrate and then a solder layer is coated on the fixed conductive paint. Alternatively, other known methods of forming printed circuits may be employed for forming the electrodes.

A ground connecting plate 13 formed in a broad inverted V-shape is soldered at its ends 24, 25 to ground electrodes 3 and 4, respectively.

A resistor 6 is connected between the input electrode 2 and the first ground electrode 3 and a resistor 8 is connected between the output electrode 5 and the second ground electrode 4. Resistor 8 is positioned symmetrical to the resistor 6 with respect to the center of the insulator plate 1. A resistor 7 is connected between points on the input electrode 2 and the output electrode 5 which are symmetrical with respect to the center of insulator plate 1.

Thus the three resistors 6, 7 and 8 together constitute a $\pi$-type attenuator circuit wherein the structural arrangement and dimensions thereof is symmetrical with respect to the center of the insulator substrate 1. Alternatively, other types of attenuator circuit such as O-type can be used in a symmetrical relationship with respect to the center of substrate 1.

Resistors 6, 7 and 8 are film-type resistors closely adhering to the insulator substrate 1, or film type chip resistors, which are firmly secured on exact positions on the electrodes by soldering terminals at their ends to the electrodes.

At an end part of the input electrode 2, a hole 14 for connection is provided, and at the corresponding position on the output electrode 5 another hole 15 for connection is provided. Thus, the holes 14 and 15 are also symmetrical with the center of the insulation substrate 1.

The abovementioned construction is then installed in an shielded enclosure 19 (FIG. 2) while connecting an input metal strip 16 and an output metal strip 17, which are inserted in the connection holes 14 and 15, to the input electrode 2 and the output electrode 5, respectively. The enclosure 19 has a shielding metal film 18 which is grounded through outer cylindrical conductors 161 and 171 of an input coaxial cable connector 162 and an output coaxial cable connector 172, respectively.

Figure 3:
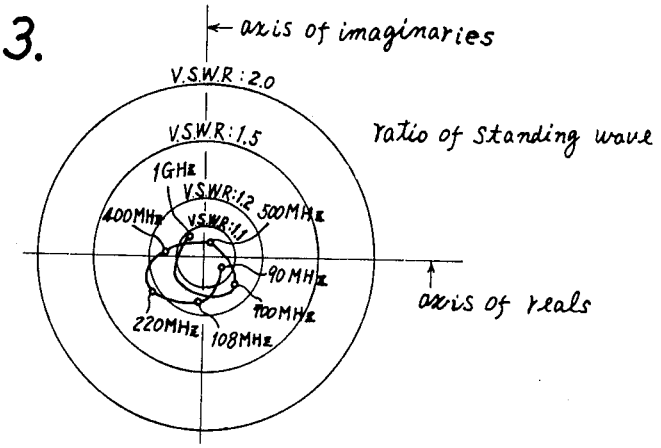
FIG. 3 is a polar diagram showing voltage standing wave ratios of an example of the present invention.

A connecting tab 23 of the ground connecting plate 13 is then connected to a part of the shielding metal film 18. Inner conductors 163 and 173 of the coaxial cable 162 and 172 are connected to the metal strips 16 and 17, respectively. The signal attenuator of the present invention has the following features:

1. By means of the abovementioned symmetrical arrangement of electrodes 2, 3, 4 and 5 and resistors 6, 7 and 8, the effects of vector impedance angles of the input impedance and output impedance are offset, and the values of the input impedance and the output impedance are made close to one another. Therefore, the characteristics at both the input terminal and the output terminal are very much improved, thereby resulting in low VSWR (voltage standing-wave ratio) values below 1.25 even for the UHF range, as shown in the polar diagram of FIG. 3.

2. The attenuator circuit, composed of resistors without conventional lead wires having undesirable inductance, are arranged in exact positions, and therefore, both the input impedance and output impedance of the attenuator circuit controlled to have exact values. Moreover, on account of the elimination of undesirable inductance of conventional lead wires, there is substantially no resonance peak in attenuation performance for a wide range of frequencies of from 50 Hz to 1 GHz ($1 \times 10^9$ Hz), resulting in very constant attenuation within a wide range.

Figure 4:
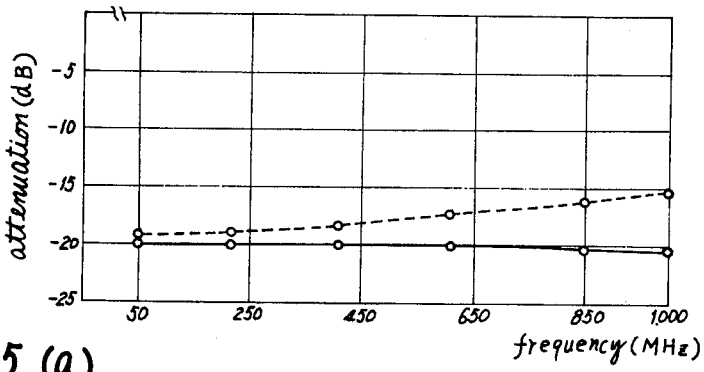
FIG. 4 is a graph showing relation between the frequency and attenuation of the example of the invention.
Figure 5:
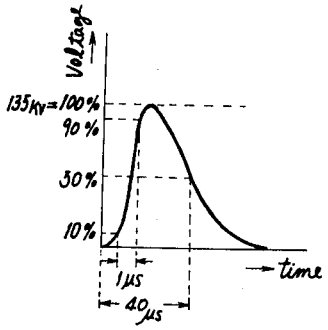
FIG. 5(*a*) is a graph illustrating a voltage waveform of a testing impulse wave applied to test the attenuator of the present invention.
Figure 5:
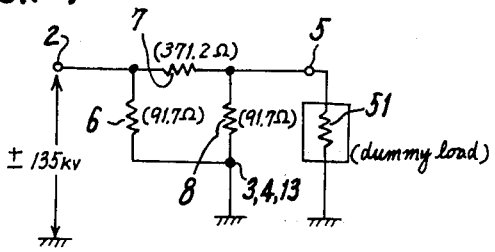
Figure 5:
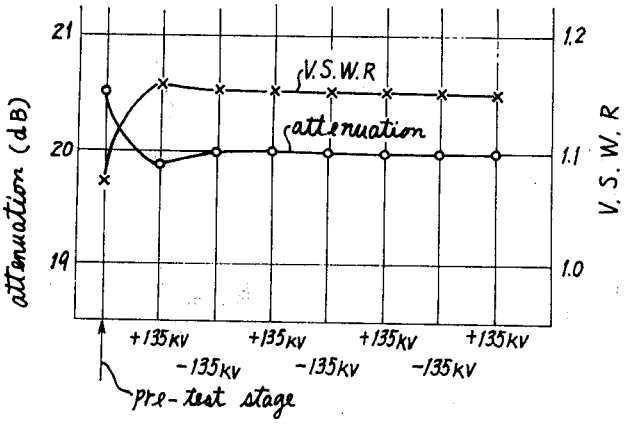

FIG. 4 shows the relationships between the attenuations and frequencies of an example of the present invention schematically shown by FIG. 5(*b*), wherein the dotted curve shows the attenuation without any shielding film coated on the surfaces of the enclosure box 19 and the solid curve shows the attenuation with the shielding film 18 on the inside surfaces of the box 19.

3. Against high voltage impulse waves caused by lightning, the main discharge gaps 9 and 11 and auxiliary discharge gaps 10 and 12 function to discharge the impulse waves by substantially bypassing them to ground. Therefore, none of the resistors or electrodes, nor the insulator substrate, suffers any damage by the impulse waves, thus assuring high performance even after many repetitions of the high voltage impulse waves.

4. FIG. 5(*a*) shows a high voltage impulse wave used in testing the durability of the attenuator of the present invention. FIG. 5(*b*) is a circuit diagram of the attenuator tested, wherein the resistors have the following resistances:

resistor 6 . . . 91.7Ω
resistor 7 . . . 371.2Ω
resistor 8 . . . 91.7Ω
a dummy resistor 51 connected between the output terminal 5 and ground . . . 75Ω
a characteristic impedance of a coaxial cable connected across the input terminal 2 and the ground . . . 75Ω.

FIG. 5(*c*) shows the durability characteristics for 777 MHz operation of the attenuator of FIG. 5(*b*) against repeated high voltage impulse wave tests. In FIG. 5(*c*), abscissa indicates repeated alternate applications of +135 kilovolts and −135 kilovolts between the input electrode 2 and ground. As shown in FIG. 5(*c*), the attenuator of the present invention shows such satisfactory low characteristics in V.S.W.R. as 1.15 for 777 MHz after alternate applications of four times of −135 kV and three times of −135 kV. Also, as shown in FIG. 5(*c*), the present attenuator performs stable and satisfactory attenuation after the same test.

5. The attenuator of the present invention is fully shielded by the shielding film 18, and therefore, no undesirable signals are picked up directly from electromagnetic waves in space by the electrodes and elements of attenuator, hence eliminating interference between the input signal and undesirably picked up random signals.

I claim:

1. A signal attenuator capable of withstanding the effects of lightning applied thereto, said attenuator comprising:

an insulator substrate having on one surface thereof an input electrode, an output electrode, and a pair of elongated ground electrodes, said input electrode and said output electrode being arranged symmetrically with respect to a point on said substrate, each of said input and output electrodes formed with a pair of intersecting arms angularly disposed with respect to one another, said ground electrodes being arranged symmetrically with respect to said point, the first of said ground electrodes being arranged with its opposite ends spaced respectively from a free end of one arm of said input electrode and from a free end of one arm of said output electrode to form a first lightning discharging gap between the first ground electrode and said input electrode and a second lightning discharging gap between the first ground electrode and said output electrode, the second of said ground electrodes being arranged with its opposite ends spaced respectively from a free end of the other arm of said input electrode and from a free end of the other arm of said output electrode to form a third lightning discharging gap between said second ground electrode and the input electrode and a fourth lightning discharging gap between said second ground electrode and the output electrode, a first flat-shaped resistor disposed on said insulator substrate and connected between the input electrode and said second ground electrode, a second flat-shaped resistor disposed on said insulator substrate and connected between the output electrode and the first ground electrode, said first and said second resistor being of the same resistance and arranged symmetrically with respect to said point, a third flat-shaped resistor connected between the free end of the one arm of the input electrode and the free end of said other arm of the output electrode, and a shielding enclosure which encloses said attenuator.

2. A signal attenuator according to claim 1, wherein said gaps are between 0.1mm and 2mm in width.

3. A signal attenuator according to claim 1, wherein said ground electrodes are connected in common to said shielding enclosure by a ground-connecting inverted U-shaped conductive plate.

4. A signal attenuator according to claim 1, wherein said shielded enclosure is a box having shielding metal film on inside surfaces thereof.

5. A signal attenuator capable of withstanding the effects of lightning applied thereto, said attenuator comprising:

an oblong insulator substrate having on one surface thereof an input electrode, an output electrode, and a pair of elongated ground electrodes, said input electrode and said output electrode being arranged symmetrically with respect to a center point on said substrate, each of said input and output electrodes being formed in L shape with a pair of intersecting arms angularly disposed with respect to one another and the corners of said L shape electrodes being disposed at opposite corners of said oblong substrate, respectively, and connecting parts of said input electrode and output electrode being disposed at the opposite shorter edges of oblong substrate, said ground electrodes being arranged symmetrically with respect to said point, the first of said ground electrodes being arranged with its opposite ends spaced respectively from a free end of one arm of said input electrode and from a free end of one arm of said output electrode to form a first lightning discharging gap of 0.1mm to 2mm between the first ground electrode and said input electrodeand a second lightning discharging gap of 0.1mm to 2mm between the first ground electrode and said output electrode, the second of said ground electrodes being arranged with its opposite ends spaced respectively from a free end of the other arm of said input electrode and from a free end of the other arm of said output electrode to form a third lightning discharging gap of 0.1mm to 2mm between said second ground electrode and the input electrode and a fourth lightning discharging gap of 0.1mm to 2mm between said second ground electrode and the output electrode, said first discharging gap and the fourth discharging gap being arranged symmetrically with respect to said point, said second discharging gap and the third discharging gap being arranged symmetrically with respect to said point, a first flat-shaped resistor disposed on said insulator substrate and connected between the input electrode and said second ground electrode, a second flat-shaped resistor disposed on said insulator substrate and connected between the output electrode and the first ground electrode, said first and said second resistor being of the same resistance and arranged symmetrically with respect to said point, a third flat-shaped resistor connected between the free end of the one arm of the input electrode and the free end of said other arm of the output electrode, and a shielding enclosure which encloses said attenuator.

* * * * *